United States Patent [19]

Weber et al.

[11] 4,154,046

[45] May 15, 1979

[54] APPARATUS FOR PROCESSING DEVELOPED PHOTOGRAPHIC PRINTS AND FILMS

[75] Inventors: Klaus Weber, Leverkusen; Friedrich Hujer, Grünwald, both of Fed. Rep. of Germany

[73] Assignee: AGFA-Gevaert, A.G., Leverkusen, Fed. Rep. of Germany

[21] Appl. No.: 892,731

[22] Filed: Apr. 3, 1978

[30] Foreign Application Priority Data

Apr. 9, 1977 [DE] Fed. Rep. of Germany ..... 2716012

[51] Int. Cl.[2] ..... B65B 57/10; B65B 61/06

[52] U.S. Cl. ..... 53/495; 53/54; 53/386; 53/520; 53/542; 83/521; 83/650

[58] Field of Search ..... 53/54, 495, 520, 386, 53/542; 83/520, 521, 650

[56] References Cited

U.S. PATENT DOCUMENTS

| | | | |
|---|---|---|---|
| 2,591,519 | 4/1952 | Decker | 83/520 X |
| 4,086,836 | 5/1978 | Jensen et al. | 83/521 |

*Primary Examiner*—Travis S. McGehee

*Attorney, Agent, or Firm*—Peter K. Kontler

[57] ABSTRACT

Webs of customer films and webs of related prints are transported in synchronism vertically downwardly toward a severing unit which subdivides the films into sections each of which includes several film frames and which simultaneously subdivides the web of prints into discrete prints. The film sections and the related discrete prints are gathered in separate magazines immediately below the severing unit and are automatically transferred into neighboring compartments of a pocket below the magazines when one of the magazines collects all sections of a customer film and the other magazine collects all related prints. Two closely adjacent windows are provided above the severing unit side-by-side to allow for simultaneous observation of film frames and related prints.

28 Claims, 4 Drawing Figures

APPARATUS FOR PROCESSING DEVELOPED PHOTOGRAPHIC PRINTS AND FILMS

BACKGROUND OF THE INVENTION

The present invention relates to apparatus for processing developed customer films and related photographic prints. More particularly, the invention relates to improvements in apparatus wherein exposed and developed photographic films are subdivided into sections of predetermined length (each such section may comprise a certain number, e.g., four, five or six, film frames) and wherein webs of coherent photographic prints are subdivided into discrete prints prior to mailing or shipment of film sections and related prints to dealers or customers.

It is already known to mount a commercially available film severing device on a table next to a commercially available severing device for webs of photographic paper. The webs of film are fed into the respective severing device along a horizontal path, the same as the webs of photographic paper. The film is severed at regular intervals along frame lines between selected film frames to yield sections of desired length, namely, sections which can be readily introduced into a relatively small pocket for shipment or delivery to the dealer or customer. The web of photographic paper is severed at regular intervals in response to detection of suitable indicia (notches, perforations, dark spots or the like) one of which is applied to the paper web for each discrete print. The webs of film and photographic paper are transported and severed in synchronism to insure that one and the same pocket will receive all film sections and all prints belonging to a given customer. Successive prints are observed for the purpose of detecting and segregating unacceptable prints, and the unacceptable prints are caused to enter a separate path so that they cannot be admitted into the pocket which is shipped to or picked up by a dealer or customer. Successive film sections project through a gap downstream of the film severing device and are withdrawn by hand for insertion into the respective compartment of the pocket. The stack of satisfactory related prints is grasped by hand and introduced into the other compartment of the same pocket. The trailing end of each customer film is provided with a customary marker which is detected by a scanning unit to temporarily arrest the severing devices. The severing devices are or can be restarted in automatic response to withdrawal of the last film section of a customer film.

The just described apparatus for the processing of photographic films and webs of related prints exhibit a number of serious drawbacks. First of all, when conventional severing devices for films and webs of prints are mounted on the top of a table of normal height, the paths for the films and webs of photographic prints are located well above the eye level of an attendant who is sitting in front of the table. Therefore, the attendant can manipulate the film sections and discrete prints but is unable to observe, at the same time, the film frames and related prints on their way toward the corresponding severing stations. Observation of film frames and adjacent prints ahead of the severing stations is desirable in each instance, i.e., regardless of the complexity of the apparatus, and is absolutely necessary when the film frames and the prints are not monitored by automatic means. In the absence of visual examination (or, at the very least, in the absence of spot checks), film sections are likely to be introduced into wrong pockets so that a customer receives prints belonging to his order but in the same pocket with another customer's film sections or vice versa. Furthermore, manual gathering of film sections and of stacks of related discrete prints is a time-consuming operation which is much slower than the rate at which the severing devices can cut webs of photographic films and webs of photographic paper. Consequently, the periods of idleness of severing devices are extended as well as frequent. Still further, manual gathering of film sections which are located in horizontal planes and of stacks of horizontal prints is also time-consuming. In other words, it takes an attendant a relatively long interval of time to properly collect all film sections and all discrete prints which form part of a customer order. Finally, manual insertion of gathered film sections and stacks of related discrete prints into the corresponding compartments of one and the same pocket also consumes much time, especially if the pockets are relatively small in order to save space and shipping costs and if the pockets must be opened by hand.

OBJECTS AND SUMMARY OF THE INVENTION

An object of the invention is to provide an apparatus for manipulating exposed and developed customer films and the webs of related photographic prints in a time- and space-saving operation.

Another object of the invention is to provide the apparatus with novel and improved means for guiding the webs of photographic films and photographic prints toward the location or locations where the webs are severed to respectively yield film sections of requisite length and discrete photographic prints.

A further object of the invention is to provide an apparatus which allows for inspection of film frames and photographic prints ahead of the severing location or locations by a person who is comfortably seated in front of the apparatus.

An additional object of the invention is to provide an apparatus whose output greatly exceeds the output of heretofore known apparatus which serve the same purpose.

Another object of the invention is to provide a versatile apparatus which can be rapidly and conveniently converted for the processing of relatively wide or relatively narrow photographic films and/or webs of photographic prints.

A further object of the invention is to provide the apparatus with novel and improved means for severing the webs of films and photographic prints and with novel and improved means for gathering severed film sections and discrete prints preparatory to automatic introduction into pockets or analogous containers.

An additional object of the invention is to provide the apparatus with novel and improved means for introducing sets of related film sections and stacks of associated discrete prints into pockets or analogous containers.

An additional object of the invention is to provide a novel and improved mounting for the means which guide webs of photographic customer films and webs of coherent photographic prints to the severing location or locations.

A further object of the invention is to provide an apparatus whose floor space requirements are a small fraction of floor space requirements of heretofore known apparatus, which is relatively simple and inexpensive, and wherein all such parts which require sporadic or frequent inspection are readily accessible from one or more sides.

Another object of the invention is to provide the apparatus with novel and improved means for automatically classifying discrete prints of a customer order according to quality and/or other characteristics and for automatically preventing the shipment or delivery of unsatisfactory prints to dealers or customers.

A further object of the invention is to provide an apparatus whose manipulation is less tiresome to an attendant than the manipulation of heretofore known apparatus in spite of the fact that the output of the improved apparatus can greatly exceed (and normally greatly exceeds) the output of conventional apparatus.

An ancillary object of the invention is to provide the apparatus with novel and improved carrier means for supplies of photographic customer films and coherent photographic prints.

An additional object of the invention is to provide the apparatus with relatively simple monitoring means and controls which facilitate the task of the attendant and contribute to higher output and greater versatility of the apparatus.

A feature of the invention resides in the provision of an apparatus for simultaneously manipulating successive elongated webs of photographic films wherein the neighboring film frames are separated by frame lines, and successive elongated webs of prints bearing the images of the film frames. The apparatus comprises a support (e.g., an upright frame or housing which is mounted on the top of a table), first and second guide means provided on the support (preferably at the front side of the support which faces an attendant who is seated in front of the apparatus) and respectively defining substantially vertical elongated first and second paths, means for respectively conveying webs of films and related coherent prints in synchronism and downwardly along the first and second paths, and means for respectively subdividing the webs in the two paths into film sections and related discrete prints. The subdividing means comprises severing means which is operative to cut the webs of films along the frame lines between selected neighboring film frames, and the guide means include closely adjacent windows located side-by-side at a level above the subdividing means to permit simultaneous observation of film frames and prints in the respective paths by a person who is seated or is standing in front of the apparatus.

The windows are preferably separated from each other by a gap having a width which need not exceed and preferably at most equals the width of a web in the first path.

At least one of the guide means preferably comprises a first portion which is fixedly secured to the support adjacent to the other guide means and a second portion which is movable toward and away from the first portion to thereby change the width of the respective path. This renders it possible to rapidly convert the apparatus for the processing of webs of films and/or prints of different widths.

The severing means extends transversely across the first and second paths and is preferably operative to sever a web in the first path simultaneously with severing of a web in the second path. Such severing means may comprise a mobile knife, a stationary counterknife and means for moving the mobile knife relative to the counterknife.

The apparatus preferably further comprises first and second magazines which are respectively located below the first and second paths to respectively gather film sections and the related discrete prints, a tray or other suitable means for supporting pockets or analogous containers for gathered film sections and related discrete prints below the magazines, and means for effecting the transfer of gathered film sections and related discrete prints from the respective magazines into a pocket therebelow. The magazines are preferably disposed immediately below the severing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
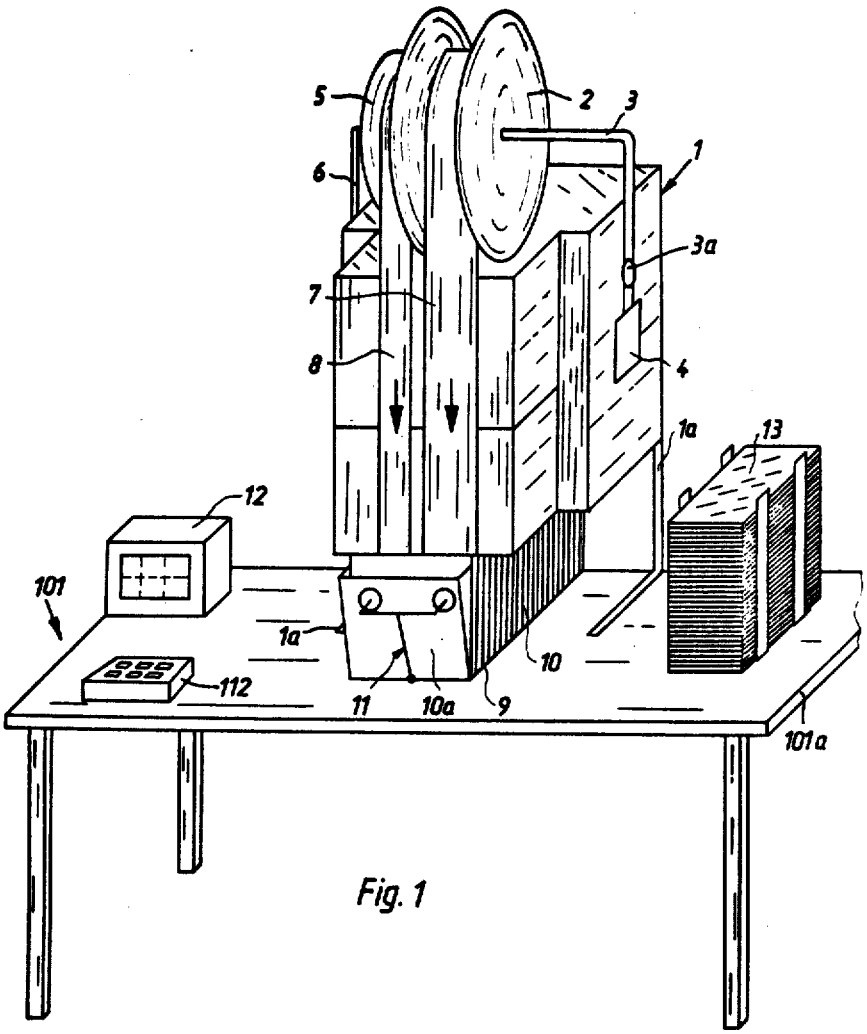
FIG. 1 is a schematic perspective view of the improved apparatus, further showing a table which supports the apparatus, a tray for containers, a viewing or inspecting unit and a stack of envelopes.

FIG. 1 shows that the apparatus is mounted on a table 101 which further supports a stack of envelopes 13. Each envelope 13 is provided with the customer's or dealer's address, code number and other information. The envelopes 13 are stacked in the same order in which the webs 8 of photographic customer films are spliced together, end-to-end, in a manner which is customary for the transport of a long strip of films through a photographic copying machine in a photographic processing laboratory.

The apparatus comprises a frame or housing 1 whose legs **1*a* rest on and are secured to the top 101*a* of the table 101. The housing 1 serves as a support for the majority of components of the improved apparatus. The legs 1*a* maintain the major part of the housing or support 1 at a certain level above the table top 101*a* so that there is room for a receptacle (e.g., a tray 9) which contains a row (horizontal stack) of containers 10** (hereinafter called pockets).

Figure 2:
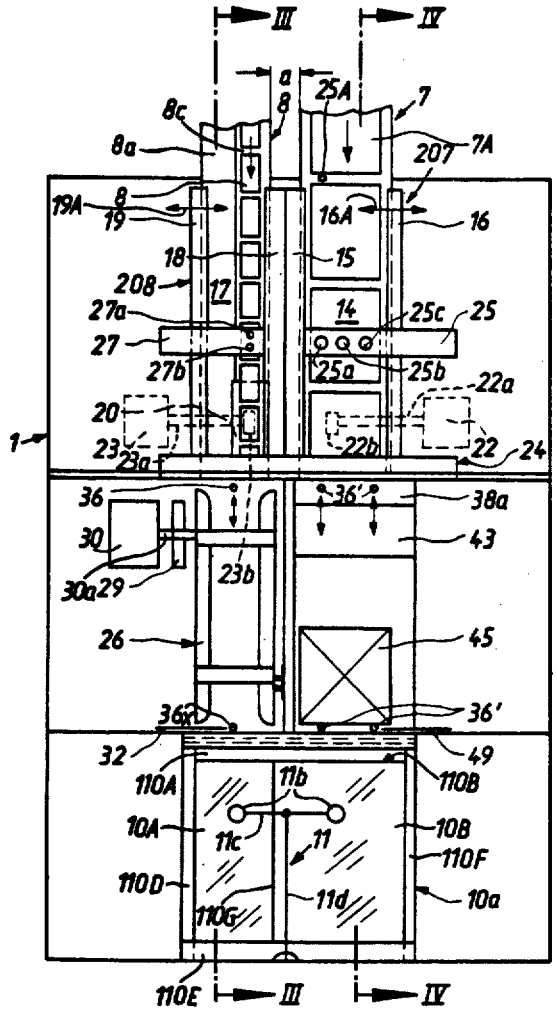
FIG. 2 is a front elevational view of the apparatus.

The upper portion of the housing 1 supports a pivot **3*a* for an L-shaped arm 3 which carries a reel 2 for a web 7 of coherent photographic prints 7A (see FIG. 2). The lowermost portion of the arm 3 is connected with a counterweight 4 which enables an attendant to move the reel 2 between operative and inoperative positions with a minimum of effort. When the reel 2 is to receive a fresh web 7, it is moved to the illustrated (inoperative) position. A second arm 6 at the other side of the housing 1 supports a reel 5 for a web of photographic films 8. The counterweight at the lower end of the arm 6 and the pivot for the arm 6 are not shown in FIG. 1. The manipulation of the arm 6 and reel 5 is analogous to that of arm 3 and reel 2, i.e., the reel 5 is also movable between an inoperative position (for attachment of a fresh web 8 of customer films) and an operative position in which the web 8 can be conveyed downwardly along a substantially vertical path which is parallel to and coplanar with the substantially vertical path for the paper web 7 in the operative position of the arm 3 and reel 2. In their operative positions, the reels 2 and 5 are located behind the positions shown in FIG. 1**.

The housing 1 further carries suitable guide rolls and loop formers for the webs 7 and 8; such parts have been omitted for the sake of clarity. FIG. 2 shows that the left-hand marginal portion of the web 8 is connected with a tape **8*a* for information pertaining to the adjacent film frames 8*b*. The neighboring film frames 8*b* are separated from each other by transversely extending frame lines 8*c*. The tape 8*a* is attached to the web 8 prior to transport of films through the copying machine and bears information which is in part identical with that on the corresponding envelopes 13. A reader in the copying machine decodes the information on the tape 8*a*** and transmits appropriate signals for adjustment of exposure controls, for the number of prints to be made, that the respective film frame is unfit for the making of prints and/or others.

Figure 3:
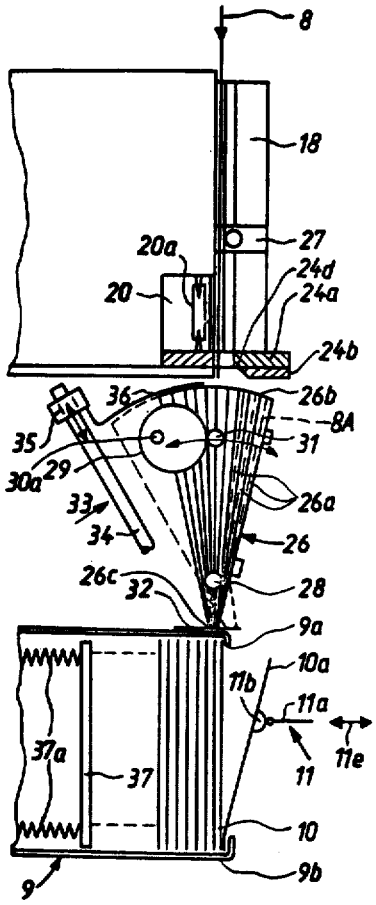
FIG. 3 is a transverse vertical sectional view as seen in the direction of arrows from the line III—III of FIG. 2.
Figure 4:
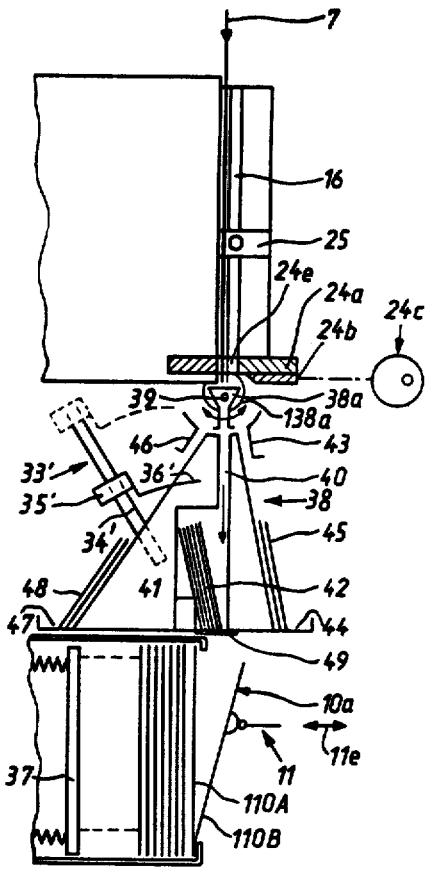
FIG. 4 is a transverse vertical sectional view as seen in the direction of arrows from the line IV—IV of FIG. 2.

The pockets 10 in the tray 9 below the housing 1 are preferably of the type disclosed in our commonly owned copending application Ser. No. 885,115 filed Mar. 10, 1978 for "Container for photographic films and prints". The foremost pocket **10*a* is located in line with the lower ends of the substantially vertical paths for the sections 8A (see FIG. 3) of a photographic customer film and related discrete prints 7A, namely, prints bearing the images of frames 8*b* of film sections 8A which are introduced into the same pocket (10*a*). The pocket 10*a* has a narrower compartment 10A for a set of film sections 8A and a wider compartment 10B for a stack of related prints 7A. The upper ends of the compartments 10A, 10B are unsealed and are held wide open by an opening mechanism 11 certain details of which are shown in FIGS. 3 and 4**.

The top **101*a* of the table 101 further supports an indicating unit 12 which, in its simplest form, may constitute a counter for acceptable prints 7A. Alternatively, and as disclosed in the commonly owned copending application Ser. No. 804,393 filed June 7, 1977 by August Hell et al. for "Apparatus for assembling and packing photographic prints with associated developed films", now U.S. Pat. No. 4,115,981, the indicating unit 12 may include a computer and a printer which provides adhesive-coated labels with information including the number of acceptable prints, the code number of the customer or dealer, the cost of the order (including development of the film and the making of prints), the account of the customer or dealer, the date of completion of the order, the address of the customer or dealer and/or others. The labels are applied to the pockets 10 or to the corresponding shipping envelopes 13**.

Referring to FIG. 2, the front side of the housing 1 supports two discrete guide means 208 (for the web 8) and 207 (for the web 207). The guide means 207 comprises a first or inner portion or rail 15 which is fixedly secured to the housing 1 and a second or outer portion or rail 16 which is adjustably affixed to the front side of the housing 1 so that it is movable between a plurality of positions. The directions in which the rail 16 is adjustable are indicated by the double-headed arrow 16A. Such adjustments are desirable in order to enhance the versatility of the apparatus, i.e., the vertical path for the web 7 can be made wider or narrower in order to properly accommodate paper webs of any one of several widths. A portion of the guide means 207 defines an observation window 14 which can be readily seen by an attendant standing or sitting in front of the table 101 (i.e., in front of the vertical paths for the webs 7 and 8) in order to inspect the motif of the print 7A behind the window 14.

The guide means 208 also comprises a first or inner portion 18 which is a rail fixedly secured to the front side of the housing 1, and a second or outer portion or rail 19 which is adjustable relative to the rail 18 in directions indicated by double-headed arrow 19A. The width of the guide means 208 will be changed when a series of narrower webs 8 is followed by a series of wider webs or vice versa. A portion of the guide means 208 constitutes a second observation window 17 which allows for inspection of film frames **8*b* therebehind. The windows 14 and 17 are located side-by-side at the same level so that an attendant can determine, at a glance, whether or not the print 7A behind the window 14 bears the image of a film frame 8*b* behind the window 17**.

Since the inner rails 15 and 18 are not adjustable (or need not be adjustably mounted on the housing 1), they can be made of a single piece of suitable metallic, plastic or other material. The distance a between the windows 14 and 17 is preferably small so that it is more convenient for the attendant to simultaneously observe a film frame and the related print. As a rule, the distance a need not exceed and preferably at most equals the width of the web 8. This distance is independent of the width of the webs 7 and 8; therefore, a pocket **10*a* below the vertical paths for the webs 7 and 8 can receive sets of film sections 8A and stacks of related prints 7A regardless of the width of the webs 7 and 8. All that is necessary is to manufacture the pockets 10 in such a way that their compartments 10A and 10B can respectively receive film sections 8A of several widths and that their compartments 10B can receive stacks of prints 8B** of any one of several widths which are customary in connection with the making of reproductions of images of frames of customer films.

The window 17 preferably contains a relatively large and suitably illuminated pane or an analogous optical element 20 (e.g., a magnifying glass) to further facilitate the attendant's task in making continuous or spot checks in order to ascertain whether or not the web 8 moving downwardly along the path defined by the guide means 208 and the (still) coherent prints 7A moving downwardly along the path defined by the guide means 207 belong to one and the same customer. FIG. 3 shows a light source **20*a* which is located behind the film-frames 8*b* in the window 20. The means for conveying the webs 7 and 8 downwardly in synchronism with each other comprises two discrete motors 22, 23 whose output elements 22*a*, 23*a* respectively carry gears 22*b*, 23*b* having teeth extending into the rows of perforations (not specifically shown) in the respective webs. The exact nature of means for insuring accurate synchronization of movements of film frames 8*b* and related prints 7A** forms no part of the present invention.

The windows 14 and 17 are disposed at a level above a severing station for a subdividing unit 24 which (in the illustrated embodiment) is common to the webs 7 and 8.

As shown in FIGS. 3 and 4, the subdividing unit 24 comprises a stationary severing means or counterknife 24a, a mobile severing means or knife 24b, and a mechanism 24c for moving the knife 24b relative to the counterknife 24a. The knives 24a and 24b extend transversely across both paths, i.e., the cutting edge 24d of the knife 22b separates the lowermost print 7A from the web 7 simultaneously with separation of a film section 8A from the web 8 along the frame line 8c between two neighboring film frames 8b when it performs a working stroke (in a direction to the left, as viewed in FIG. 3 or 4). The mechanism 24c may comprise suitable eccentrics (one shown in FIG. 4) which are driven by a prime mover and cause the knife 24b to move back and forth in a horizontal plane immediately adjacent to the underside of the counterknife 24a. The latter has an elongated slot 24e through which the webs 7 and 8 extend. If desired, the subdividing means 24 can be designed to provide the prints 7A with rounded corners. The details of the subdividing means 24 form no part of the present invention; in fact, it is equally possible to provide two discrete severing means, one for the web 7 and another for the web 8. The illustrated subdividing means is preferred at this time owing to its simplicity and the simplicity of means which control the prime mover of the mechanism 24c.

The housing 1 further supports a scanning unit 25 which is mounted on the housing in the region of the observation window 14 at a distance of approximately one and one-half print lengths ahead of the subdividing means 24. The lengths of prints 7A are measured in the longitudinal direction of the web 7. The scanning unit 25 comprises three discrete detectors 25a, 25b and 25c. The detector 25a transmits signals in response to detection of indicia 25A (e.g., notches, perforations, graphite marks, marks applied by a ball point pen or others) which denote the locus where the means 24 is to sever the web 8. The detector 25b transmits signals in response to detection of indicia (not shown) which denote unsatisfactory prints (i.e., prints which should not reach the dealer or customer), and the detector 25c transmits signals in reponse to detection of an indicium denoting the last print 7A of a customer order. The manner in which the just discussed indicia are applied to the web 7 is known. Signals which are transmitted by the detector 25a are used for actuation of the mechanism 24c, signals which are transmitted by the detector 25b are used to segregate the respective (unsatisfactory) prints from satisfactory prints ahead of the pocket 10a, and signals which are transmitted by the detector 25c are used to effect the introduction of a stack of prints 7A into the compartment 10B of the pocket 10a therebelow. The detectors 25a–25c can be mounted side-by-side, i.e., in a common horizontal plane and may include mechanical sensors, photocells or any other conventional detector means, depending on the nature of indicia on the web 7. An advantage of the placing of detector 25b ahead of the subdividing means 24 is that unsatisfactory prints (if any) can be segregated immediately below the subdividing station, i.e., that the knives 24a, 24b need not be mounted at a level well above the pocket 10a which is about to receive film sections 8A and related prints 7A. In other words, the overall height of the apparatus can be reduced considerably without affecting its versatility.

A second scanning unit 27 is mounted at the front side of the housing 1 at the level of the scanning unit 25, i.e., adjacent to the window 17. The scanning unit 27 includes an adjustable detector 27a for the notches and/or perforations of several types of films (including 110/126/135 and 120) and a second detector 27a which generates signals in response to detection of splices between successive customer films of the web 7. The detection of a splice is tantamount to detection of the last frame of a customer film. Signals which are transmitted by the detector 27a are utilized to insure that the knives 24a and 24b sever the web 8 along selected frame lines 8c, and signals which are generated by the detector 27b serve to effect the introduction of a set of film sections 8A into the compartment 10A of the foremost pocket 10a in the tray 9.

FIG. 3 shows a first magazine 26 which is located between the lower end of the path for the web 8 and the compartment 10A of the foremost pocket 10a in the tray 9. The magazine 26 gathers the film sections 8A which belong to a customer and includes means for effecting the transfer of gathered sections 8A into the compartment 10A therebelow. This magazine is similar to one of the magazines which are disclosed in commonly owned U.S. Pat. No. 4,073,118 granted Feb. 14, 1978 to Weber et al. It comprises a series of compartments 26a which are arranged fanwise, i.e., the depth of each compartment 26a (as measured in the plane of FIG. 3) decreases in a direction from its open upper end 26b toward its open lower end 26c. The compartments 26a are rigidly connected to each other so that they can turn, as a unit, about the horizontal axis of a shaft 28 which is mounted in the housing 1 or on the table 101. The means for pivoting the compartments 26a so as to place the open upper ends 26b into register with the slot 24e in the counterknife 24a in a predetermined sequence (e.g., seriatim) includes a disk-shaped cam 29 which is eccentrically mounted on the output element 30a of a motor 30 (shown in FIG. 2) and whose periphery is tracked by a roller- or pin-shaped follower 31 on the magazine 26. Means (not shown) is provided to bias the follower 31 against the cam 29. The magazine 26 further comprises a gate 32 or an analogous barrier which is movable to and from the intercepting position of FIG. 3, i.e., to and from a position below the open lower ends 26c of the compartments 26a. The gate 32 is retracted with requisite delay in response to a signal from the detector 27b, i.e., in response to detection of the last frame 8b of a customer film.

The magazine 26 further comprises a pusher 36 which is movable into and along the compartments 26a in a direction from the open upper ends 26b toward the open lower ends 26c when the gate 32 is retracted to thereby invariably insure that all film sections 8A which belong to a customer are expelled from the respective compartments and are introduced into the compartment 10A of the pocket 10a. The pusher 36 is movable in a centrally located slot between the two halves of the unit including the compartments 26a. Reference may be had to FIG. 2 of the aforementioned U.S. Pat. No. 4,073,118. The pusher 36 forms part of an expelling mechanism 33 which further includes a suitably inclined tie rod or guide 34 for a slide 35 supporting the pusher 36. The movements of the motor 30 are synchronized with movements of the mobile knife 24b to insure that an empty compartment 26a is located below the lower end of the path for the web 8 whenever the knife 24b performs a working stroke. The expelling mechanism 33 is actuated in response to signals which are generated by the detector 27b but with sufficient delay to insure that the last film section 8A of a film has entered the respective compartment 26a before the gate 32 is retracted from its intercepting position. The pusher 36 then moves from the upper end position of FIG. 3 to a lower end position to thereby advance all sections 8A into the compartment 10A therebelow. The pusher 36 further insures that all film sections in the compartment 10A overlap each other, i.e., that the pocket 10a can be readily introduced into the respective envelope 13. The means for moving the pusher 36 between the upper and lower end positions is not specifically shown because such moving means may be identical with one of the moving means described and shown in the aforementioned U.S. Pat. No. 4,073,118. It is clear that the pusher 36 is retracted to the position of FIG. 3 in good time before the foremost section of the next customer film is separated from the remaining (upper) portion of such film. Also, the cam 29 causes or allows the compartments 26a to return to their starting positions so that they can move into register with the slot 24a in the sequence which is determined by configuration of the periphery of the cam 29. The upper and lower end positions of the pusher 36 are shown in FIG. 2, as at 36 and 36x.

The tray 9 for pockets 10 comprises a pressure plate 37 which is urged forwardly by helical springs 37a or other suitable biasing means to bear against the rearmost pocket 10 of the row of pockets and to thus maintain the foremost pocket 10a in requisite position below the paths for the webs 7 and 8. The tray 9 includes a lower stop 9b which engages the lowermost portion of the pocket 10a (in the region where the lower ends of the compartments 10A and 10B are sealed) and an upper stop 9a which engages the rear sheet or panel 110A of the pocket 10a (reference may be had again to our aforementioned commonly owned copending application Ser. No. 885,115 filed Mar. 10, 1978). A second or front sheet or panel 110B of the pocket 10a is bonded to the rear panel 110A at 110D, 110E, 110F and 110G to thus define with the panel 110A the aforementioned compartments 10A, 10B whose upper ends are unsealed. The upper marginal section of the rear panel 110A extends upwardly beyond the upper marginal section of the front panel 110B so that the stop 9a engages only the panel 110A and the mechanism 11 can open the upper ends of the compartments 10A, 10B to an extent which is necessary to insure convenient and automatic introduction of several film sections 8A and of a stack of related discrete prints 7A. The opening mechanism 11 comprises two suction heads 11b which are mounted on a yoke 11c supported by an arm 11d which is pivotally mounted in the bottom wall of the tray 9 behind the stop 9b. A device which can move the yoke 11c includes a rod 11a which is reciprocable in directions indicated by double-headed arrow 11e. The rod 11a may constitute a hollow tube which connects the heads 11b to a suction generating device (not shown) when the mechanism 11 is to open the unsealed upper ends of compartments 10A and 10B of the foremost pocket 10a. The operation of the means for moving the rod 11a is preferably synchronized with that of the mechanism for moving the gate 32 from intercepting position and for moving the pusher 36 to the lower end position 36x so that the compartment 10A is wide open when a set of film sections 8A is expelled from the corresponding compartment 26a of the magazine 26.

FIG. 4 shows a second magazine 38 which serves to accumulate satisfactory discrete prints 7A and to effect the transfer of a complete stack 42 of satisfactory prints into the compartment 10B of the foremost pocket 10a in the tray 9. The magazine 38 comprises a switching or classifying chute 38a which is pivotable about the axis of a horizontal shaft 39 parallel to the shaft 28 for the magazine 26 and extending transversely of the path for the web 7. The chute 38a is hollow, i.e., it defines a passage through which successive discrete prints 7A can descend into one of several channels 40, 43 and 46 forming part of the magazine 38 and located below the chute 38a. The width of the passage in the chute 38a (as considered at right angles to the plane of FIG. 4) at least slightly exceeds the width of the widest web 7 which is expected to be processed in the apparatus (see FIG. 2). The upper end of the passage in the chute 38a flares outwardly to insure that the leader (lower marginal portion) of the web 7 can pass therethrough irrespective of whether the print 7A which is about to be separated from the next-following print 7A is to enter the channel 40, the channel 43 or the channel 46. The shaft 39 is a two-piece body, i.e., it can consist of two stub shafts which respectively support the adjacent end walls of the chute 38a. The means (e.g., a rotary electromagnet) for pivoting the chute 38a is indicated by a circle 138a. Such pivoting means receives signals from the scanning unit 25. As a rule, the chute 38a assumes the position which is shown in FIG. 4 and in which its passage registers with the open upper end of the median (vertical) channel 40. The lower portion of the channel 40 is enlarged to form a chamber 41 which receives a full stack 42 of satisfactory prints 7A.

When the chute 38a is pivoted in a counterclockwise direction, as viewed in FIG. 4, it admits prints into the right-hand channel 43 which, in turn, allows the prints to descend onto an intercepting platform or ledge 44. The prints which accumulate on the platform 44 are denoted by the reference character 45; the corresponding frames 8b of the associated customer film must be copied anew with a different setting of exposure controls in order to obtain an acceptable reproduction which can be shipped or delivered to or picked up by a dealer or customer. When the chute 38a is pivoted clockwise, as viewed in FIG. 4, it directs exprints 48 into the channel 46 which, in turn, allows the exprints to descend onto an intercepting platform or ledge 47. The platform 44 is preferably located at the front side of the magazine 38 so that its contents can be readily removed by the attendant.

When a print 7A is separated from the next-following print as a result of operation of the subdividing means 24, the freshly separated print descends by moving in a vertical or nearly vertical plane. This is advisable and advantageous because the descending print encounters a minimum of resistance from the surrounding air. Thus, the freshly severed prints descend in a predictable manner and their introduction into one of the channels 40, 43, 46 takes up a short interval of time. This means that the subdividing means 24 can be operated at a high frequency.

It is desirable to place the channels 43 and 46 close to the respective sides of the vertical central channel 40 so that relatively small angular movements of the chute 38a suffice to effect the necessary classification of prints according to quality and/or other characteristics. The feature that the angular movements of the classifying chute 38a are relatively small also contributes to higher output of the apparatus. As mentioned above, the prints of the web 7 are monitored ahead of (i.e., above) the subdividing means 24 so that the classifying chute 38a can be pivoted in good time before the leader of a print which should not enter the channel 40 descends to the level of the upper end of this channel. As shown, the chute 38*a* is so close to the subdividing means 24 that the leader of a print which is about to be severed already extends into the appropriate channel 40, 43 or 46 before the knife 24*b* performs a working stroke to separate such print from the next-following print of the web 7. Also, the chute 38*a* can again change its position as soon as the trailing end of a print 7A leaves its passage, i.e., even before the freshly separated print fully enters the chamber 41 or descends onto the platform 44 or 47.

The magazine 38 further comprises a reciprocable intercepting gate or barrier 49 which is movable in a horizontal plane and normally constitutes the bottom wall of the chamber 41. When the gate 49 is retracted, the entire stack 42 of satisfactory prints 7A can descend into the compartment 10B of the pocket 10*a* by gravity. The means for retracting the gate 49 can be identical with the retracting means for the gate 32, i.e., such means can be actuated with a requisite delay in response to a signal from the detector 25*c* which detects indicia denoting the last prints of successive customer orders. In order to insure that all prints of the stack 42 are invariably transferred into the compartment 10B therebelow and that the prints in the compartment 10B accurately overlap each other, the magazine 38 preferably also includes a mechanism (denoted by the character 33') which is a functional and preferably also a structural equivalent of the aforedescribed expelling mechanism 33 in the magazine 26. The pusher 36' of the mechanism 33' is mounted on a slide 35' which is reciprocable along a suitably inclined tie rod 34' to expel the stack 42 from the chamber 41 when the pusher 36' moves from the upper toward the lower end position while the gate 49 is held in the retracted position.

The apparatus further comprises a suitable control system which includes the aforementioned scanning units 25, 27 and many other components to insure accurate synchronization of operation of the prime movers 22, 23, of the mechanism 24*c* for moving the knife 24*b*, of the rod 11*a* in the opening mechanism 11, of the means for moving the gates 32, 49, of the means for actuating the expelling mechanisms 33 and 33', of the motor 30, of the means 138*a* for pivoting the chute 38*a* and of mobile parts of the indicating device 12. The exact construction of such control system (which may include AND-gates, OR-gates, signal storing devices and analogous components) forms no part of the invention. However, the nature of the control system will be readily understood by those skilled in this art upon perusal of the following description of operation of the improved apparatus.

When the processing of a customer order is completed, i.e., when the foremost pocket 10*a* in the magazine 9 is filled with film sections 8A and related discrete prints 7A, the apparatus receives a signal to start the processing of the next customer order. Such start signal can be generated in automatic response to withdrawal of the pocket 10*a* from the tray 9 or by the attendant who depresses one of the knobs on a control panel 112 located within reach of the attendant's hand on the top 101*a* of the table 101. The processing of the next customer order begins or can begin while the attendant inserts the freshly removed pocket 10*a* into the corresponding envelope 13. The transmission of the start signal results in starting of the motors 22 and 23 of conveying means for the webs 7 and 8. When the detector 27*a* detects a predetermined number of successive film frames 8*b* (e.g., four, five or six frames, depending on the dimensions of such frames), the motor 23 is arrested in a position in which the leader of the web 8 extends into one of the compartments 26*a* in the magazine 26 and the frame line 8*c* between the last frame 8*b* of the foremost (still undetached) section 8A and the next-following film frame 8*b* is located in the path of movement of the mobile knife 24*b* which latter is held in the retracted position of FIG. 3.

The motor 22 drives the web 7 in a downward direction, as viewed in FIG. 2 or 4, at such a speed that the foremost (lowermost) print 7A is located below the counterknife 24*a* not earlier than when the foremost film section 8A is also located at a level below the counterknife 24*a*. The mechanism 24*c* then receives a signal (e.g., in response to stoppage of both motors 22 and 23) to cause the knife 24*b* to perform a working stroke and to separate the lowermost film section 8A from the remainder of the web 8 simultaneously with separation of the foremost print 7A from the next-following print. If the freshly severed print 7A is satisfactory, it descends into the channel 40 and comes to rest on the gate 49, i.e., such print is located in the chamber 41 and constitutes the first print of a stack 42. If the print is unsatisfactory, the classifying chute 38*a* is pivoted from the position of FIG. 4 to direct the print into the channel 43 or 46. The freshly severed film section 8A descends into one of the two outermost compartments 26*a* of the magazine 26.

It will be noted that the severing of the web 8 takes place simultaneously with severing of the web 7; however, and as mentioned above, the freshly separated film section 8A contains several frames whereas simultaneous severing of the web 7 results in separation of a single (lowermost) print 7A.

The motors 22 and 23 are set in motion as soon as the knife 24*b* returns to the retracted position, and the aforedescribed procedure is repeated again and again, until the detector 27*a* transmits a signal denoting the detection of a splice, i.e., that the trailing end of a film is about to reach the subdividing means 24. Thus, the last section 8A of a customer film descends into the compartment 26*a* therebelow before the last print 7A of the same customer order has entered the channel 40, 43 or 46. Therefore, the control system of the apparatus continues to transmit signals for actuation of the mechanism 24*c* after the last section 8A of a customer film is already located in one of the compartments 26*a*. This is necessary in order to insure that each and every print belonging to that customer order which includes the complete set of film sections 8A in the magazine 26 is caused to enter the chamber 41 or to come to rest on one of the platforms 44, 47 before the operation is interrupted and before the stack 42 is transferred from the chamber 41 into the compartment 10B of the pocket 10*a* therebelow. In other words, failure of the motor 23 to advance the web 8 downwardly upon completion of severing of a customer film need not result in termination of intermittent operation of the subdividing means 24 provided, of course, that at least one print belonging to the customer order including a complete set of film sections 8A in the magazine 26 is still located ahead of the severing station.

It can also happen that the total number of prints belonging to a customer order is less than the total number of sections 8A in a customer film. For example, such situation will arise if the previewing of a film ahead of the copying station resulted in detection of a large number of improperly exposed film frames so that the number of prints which are made from a customer film is less than the number of film sections which are obtained in response to severing of the respective film. In such instances, the severing of the film continues after the last print of the corresponding customer order is already located in the chamber 41 or rests on one of the platforms 44, 47. Another situation which also necessitates such operation that the severing of a customer film must continue after the last print of the respective customer order is already located in the magazine 38 is that when a certain number of film frames at the trailing end of a customer film is unsatisfactory for the making of acceptable prints. In such situation, the control system will cause the motor 23 to convey the web 8 downwardly and the control system will cause the subdividing means 24 to sever th film while the motor 2 is idle, i.e., while the web 7 is at a standstill and maintains the foremost print of the next customer order at the level of the observation window 14.

As mentioned above, each film section 8A enters the adjacent compartment **26*a* of the magazine 26 prior to separation from the next film section. This is due to the fact that the compartments 26*a* are closely adjacent to the subdividing means 24. Severing of the web 8 by the knife 24*b* in cooperation with the counterknife 24*a* results in gravitational descent of the freshly separated film section 8A, i.e., the lower edge face of the section 8A descends (or normally descends) onto the upper side of the gate 32. Furthermore, the motor 30 receives a signal to turn the cam 29 through a predetermined angle in order to move the open upper end 26*b* of the next (or any empty) compartment 26*a* into register with the slot 24*e* of the counterknife 24*a***.

The mounting of the scanning unit 25 at a predetermined level above the subdividing means 24 (as mentioned above, the distance preferably equals or approximates one and one-half print lengths) insures that the classifying chute **38*a* can be pivoted (if necessary) before the leader of a print 7A whichis to enter a channel other than the channel which has received the preceding print descends to the level of the upper end of the passage in the chute 38*a*. The means 138*a* for pivoting the chute 38*a* preferably comprises or constitutes a rotary electromagnet which receives signals from the control system in response to transmission of a signal from one of the detectors in the scanning unit 25. The transmission of a signal from one of the detectors in the scanning unit 25 to the electromagnet 138*a* for the chute 38*a* can take place by way of a suitable signal storing circuit which delays the transmission of signal until after the trailing end of the preceding print has advanced to a level below the passage of the chute. The motor 22 for the web 7 is started again as soon as the adjustment (if any) of the chute 38*a* is completed. This results in monitoring of a print which advances past the detectors of the scanning unit 25, and the signals (if any) from such detectors are stored for an interval of time which is necessary to insure that the freshly severed print enters the appropriate channel of the magazine 38**.

The processing of a customer order is completed after detection of a splice between successive films of the web 8 and after detection of the indicium denoting the last print of a customer order. The gates 32 and 49 are thereupon retracted and the expelling mchanisms 33 and 33' are actuated to respectively transfer a set of film sections 8A into the compartment 10A and to transfer a stack 42 of acceptable prints 7A into the compartment 10B of the foremost pocket **10*a*. The upper ends of the compartments 10A and 10B are then wide open because the mechanism 11 is actuated to maintain the upper portion of the front panel 110B away from the upper portion of the rear panel 110A. The mechanisms 33 and 33' thereupon return the respective pushers 36 and 36' to their upper end positions and the gates 32 and 49 are caused to reassume their intercepting positions. At the same time, the opening mechanism 11 is deactivated so that the panels 110A and 110B properly confine the film sections 8A and the stack 42 in the respective compartments 10A and 10B. The motor 30 returns the magazine 26 to the starting position and the motors 22 and 23 are started again to proceed with the processing of the next customer order. The attendant rapidly removes the pocket 10*a* from the tray 9 and the prints 45 (if any) from the platform 44 so that the next pocket 10 moves to the position previously occupied by the pocket 10*a* and the platform 44 is ready for reception of certain prints 45** (if any) belonging to the next customer order.

The attendant also observes the viewing screen of the indicating device 12 to jot down the number of satisfactory prints, either on the pocket **10*a* or on the corresponding envelope 13. If the apparatus is equipped with an automatic printer of the type described and shown in the aforementioned copending application of August Hell et al., the printer can furnish a label with printed information denoting the cost of transaction, the number of satisfactory prints, the name or code number of the dealer or customer and/or other data. Such label is then attached to the pocket 10*a* or to the corresponding envelope 13**.

As disclosed in our commonly owned copending application Ser. No. 885,115 filed Mar. 10, 1978, discrete pockets 10 can be replaced by a strip of interconnected containers which are stacked in zig-zag formation or in another suitable way. The utilization of coherent containers in the form of pockets 10 or the like renders it possible (or more convenient) to employ automatic means for removing filled pockets from the space below the magazines 26 and 38.

An important advantage of the improved apparatus is that the placing of observation windows 14 and 17 in a vertical plane, side-by-side and close to each other enables an attendant to check the film frames and the prints behind the respective windows in order to ascertain whether or not such prints and film frames belong to the same customer. Thus, the attendant is in a position to ascertain whether or not the motif on a print is the same as that on one of the film frames behind the optical element 20.

Another important advantage of the improved apparatus is that its space requirements are a minute fraction (approximately 30 percent) of space requirements of conventional apparatus wherein the webs are transported along horizontal paths. Furthermore, whereas presently known apparatus can complete up to 200 customer orders per hour, the apparatus of the present invention can easily complete up to and even in excess of 400 customers orders per hour. This is attributable, in part, to simultaneous introduction of film sections and discrete prints into the compartments of one and the same pocket and also to the fact that the attendant or attendants need not open the compartments of the pockets by hand. The increased output of the improved apparatus is further attributable to novel mounting of guide means and conveying means for the webs 7 and 8, i.e., the sections 8A and the prints 7A can descend by gravity with minimal resistance from the surrounding air. Moreover, such mounting insures that the prints can rapidly advance through and beyond the classifying chute 38*a* even if they are not supposed to enter the vertical central channel 40 which is in line with the path of the web 7 thereabove. Still further, and as described above, angular movements of the chute 38*a* between several positions are small and, therefore, such movements take up relatively short intervals of time. This also contributes to compactness of the apparatus because it suffices to install the scanning unit 25 at a relatively short distance from (above) the subdividing means 24.

The observation windows 14 and 17 enable an attendant to ascertain, at least from time to time, whether or not the film frames 8*b* behind the window 17 and the print or prints 7A which can be seen behind the window 14 belong to one and the same customer. The attendant will normally inspect such film frames and the adjacent prints before the apparatus begins to process a customer order, i.e., at the time when the foremost frames 8*b* of a customer film and the foremost prints 7A of frames of the same film are respectively located behind the windows 17 and 14. For example, the windows 14 and 17 can be dimensioned in such a way that the attendant can see three successive prints 7A behind the window 14 and five successive film frames 8*b* behind the window 17. As a rule, the motors 22 and 23 transport the webs 7 and 8 at a high speed so that the attendant is unable to compare the film frames with the adjacent prints when the motors are operated at normal speed. Even if the attendant would attempt to make a visual comparison, his or her eyes would become tired after a short interval of time; therefore, the film frames behind the window 17 and the prints behind the window 14 are normally compared prior to processing of a customer order and/or during the final stage of processing of a customer order. The comparison need not be very thorough, i.e., the attendant will normally seek to rapidly find some readily discernible characteristics (such as shots of mountains, larger groups of persons, the shore of a body of water or the like) which can be immediately recognized on the prints as well as on the adjacent film frames. Still further, the attendant need not check each customer order, i.e., it suffices to spot check the customer orders at certain intervals.

Another important advantage of the windows 14 and 17 is that they enable an attendant to reestablish the synchronism between the transport of a web 8 and the corresponding web 7 after detection of a malfunction (such as the absence of synchronism). The motors 22 and 23 are then operated at a greatly reduced speed so that the operator can easily compare the film frames 8*b* with the adjacent prints 7A in order to ascertain whether or not such frames and prints belong to one and the same customer as well as to eliminate the cause of absence of synchronization with a minimum of delay.

It goes without saying that the attendant can also ascertain the presence or absence of synchronism in a different way, i.e., not solely by comparing the film frames 8*b* behind the window 17 with the prints 7A behind the window 14. For example, the attendant can examine the order numbers on the film sections 8A in the compartment 10A, the order numbers on the prints 7A in the corresponding compartment 10B, and the order numbers on the corresponding envelope 13. Such order numbers must match if the prints in the pocket 10B and the film sections 8A in the corresponding pocket 8A form part of one and the same customer order.

Without further analysis, the foregoing will so fully reveal the gist of the present invention that others can, by applying current knowledge, readily adapt it for various applications without omitting features tha, from the standpoint of prior art, fairly constitute essential characteristics of the generic and specific aspects of our contribution to the art and, therefore, such adaptations should and are intended to be comprehended within the meaning and range of equivalence of the claims.

What we claim is:

1. In an apparatus for manipulating successive elongated webs of photographic films wherein the neighboring film frames are separated by frame lines and successive elongated webs of prints bearing images of said frames, the combination of a support; first and second guide means provided on said support and respectively defining substantially vertical elongated first and second paths; means for respectively conveying webs of films and related prints in synchronism downwardly along said first and second paths; and means for respectively subdividing the webs in said paths into film sections and related prints, said subdividing means comprising severing means operative to cut the webs of films along the frame lines, said guide means including closely adjacent windows located side-by-side at a level above said subdividing means to permit simultaneous observation of film frames and prints in the respective paths.

2. The combination of claim 1, wherein said windows are separated from each other by a gap having a width which at most equals the width of a web in said first path.

3. The combination of claim 1, wherein at least one of said guide means comprises a first portion fixedly secured to said support and a second portion movable toward and away from said first portion to thereby change the width of the respective path.

4. The combination of claim 3, wherein said first portion of said one guide means is adjacent to but spaced from the other of said guide means and the distance between said windows is constant in each position of said second portion of said one guide means.

5. The combination of claim 1, wherein said severing means exends transversely across said first and second paths and is operative to sever a web in said first path simultaneously with a web in said second path.

6. The combination of claim 5, wherein said severing means includes a mobile knife, a stationary counterknife, and means for moving said mobile knife cyclically with respect to said counterknife.

7. The combination of claim 1, further comprising first and second magazines respectively disposed below said first and second paths to respectively gather film sections and the related discrete prints, means for supporting pockets for gathered film sections and related discrete prints below said magazines, and means for effecting the transfer of gathered film sections and related discrete prints from the respective magazines into a pocket therebelow.

8. The combination of claim 7, wherein said magazines are disposed immediately below said severing means.

9. The combination of claim 7, wherein said first magazine comprises a plurality of neighboring compartments having open upper ends and means for moving the upper ends of said compartments into register with said first path in a predetermined sequence in synchronism with the operation of said severing means so that each of said compartments receives a discrete section of the respective web.

10. The combination of claim 9, wherein said moving means comprises means for pivoting said first magazine about a substantially horizontal axis.

11. The combination of claim 9, wherein said compartments have open lower ends and said transfer effecting means comprises a barrier movable to and from a intercepting position in which said barrier prevents the film sections from leaving the respective compartments by way of said lower ends.

12. The combination of claim 11, wherein said transfer effecting means further comprises a pusher movable into and within said compartments from said upper toward said lower ends thereof to thereby expel the film sections via said lower ends while said barrier is out of said intercepting position.

13. The combination of claim 7, wherein said second magazine comprises a plurality of discrete channels having open upper ends, classifying means disposed between said upper ends and said second path and movable between a plurality of positions in each of which a discrete print leaving said second path is directed into the upper end of a different one of said channels.

14. The combination of claim 13, wherein said classifying means is pivotable about a substantially horizontal axis.

15. The combination of claim 13, wherein the number of said channels exceeds two.

16. The combination of claim 7, wherein one of said channels is in line with the web in said second path and includes a chamber for accumulation of acceptable discrete prints.

17. The combination of claim 16, wherein another of said channels is adjacent to one side of said one channel and further comprising means for intercepting discrete unsatisfactory prints which said classifying means directs into said other channel.

18. The combination of claim 16, wherein another of said channels is adjacent to one side of said one channel and further comprising means for intercepting discrete exprints which said classifying means directs into said other channel.

19. The combination of claim 16, wherein said chamber has a bottom wall movable between open and closed positions to intercept discrete prints in said closed position and to permit evacuation of prints from said chamber in said open position thereof.

20. The combination of claim 19, wherein said transfer effecting means for expelling prints from said chamber into a pocket therebelow in the open position of said bottom wall.

21. The combination of claim 19, wherein said webs of prints are provided with indicia each denoting the last of a series of prints related to a set of film sections, and further comprising scanning means including detector means arranged to generate signals on detection of said indicia, said bottom wall being movable to said open position in response to such signals.

22. The combination of claim 21, wherein said scanning means adjacent to said window of said second guide means.

23. The combination of claim 21, wherein said scanning means is located above and is spaced apart from said subdividing means, the distance between said scanning and subdividing means approximating one and one-half times the length of a print, as considered in the longitudinal direction of the web in said second path.

24. The combination of claim 7, wherein said pockets have first and second compartments for respectively receiving sets of film sections and stacks of discrete prints, and further comprising means for opening the compartments of the pocket below said magazine during transfer of film sections and prints into the respective compartments.

25. The combination of claim 7, further comprising means for opening the pocket below said magazines during transfer of film sections and prints into such pocket.

26. The combination of claim 7, wherein said pockets together form a continuous strip.

27. The combination of claim 1, further comprising means for illuminating one of said windows.

28. The combination of claim 1, wherein the window of said first guide means comprises an optical element.

* * * * *